United States Patent [19]

Pettis

[11] Patent Number: 5,025,748

[45] Date of Patent: Jun. 25, 1991

[54] PORTABLE SCORING DEVICE

[76] Inventor: Delmar D. Pettis, W4010, County-M, West Salem, Wis. 54669

[21] Appl. No.: 485,572

[22] Filed: Feb. 27, 1990

[51] Int. Cl.[5] ..... A63F 1/18

[52] U.S. Cl. ..... 116/222; 273/DIG. 26

[58] Field of Search ..... 116/222, 225, 325, 326; 273/DIG. 26

[56] References Cited

U.S. PATENT DOCUMENTS 3,067,717 12/1962 Imparato ..... 116/173
3,213,824 10/1965 Jenkins ..... 116/222 X
4,009,679 3/1977 Kircher ..... 116/225

FOREIGN PATENT DOCUMENTS 478824 11/1951 Canada ..... 116/222

*Primary Examiner*—Daniel M. Yasich
*Attorney, Agent, or Firm*—M. Paul Hendrickson

[57] ABSTRACT

The present invention provides a portable scoring device which includes a retractable and extendable post section equipped with a ground penetrating tip and a foot brace for driving and anchoring the post section into the ground, a main frame for retractably housing the post section and supporting the post section in an extended and ground penetrating position, a score display panel affixed to the frame, and a latching mechanism for latching the post section to the frame in the extended and retracted position.

12 Claims, 2 Drawing Sheets

PORTABLE SCORING DEVICE

FIELD OF THE INVENTION

The present invention relates to scoring devices and more particularly to a portable, compact, retractable scoring device which may be expeditiously installed at a sporting event.

BACKGROUND OF THE INVENTION

Currently numerous outdoor sporting activities are conducted without the benefit of a scoreboard. Such outdoor sporting activities are often conducted at sporting sites where because of various reasons (such as expenses, vandalism, theft, etc.) it is generally unfeasible to install a permanent on-site scoreboard. Certain other sporting events have been historically conducted without scoreboards. This nay be illustrated by horseshoeing, volleyball, shuffleboarding, etc. which are typically played at a public park or similar accessible sites under circumstances wherein such scoring devices cannot be adequately protected against theft, vandalism, etc. Consequently, such sporting participants such as horseshoe players are forced to mentally keep track of the scores and announce the score to each participant upon commencement of each series of throws. Small groups of horseshoers also tend to travel considerable distances to horseshoeing meets attended by other players who likewise have traveled considerable distances to the meet. Under such circumstances, it becomes most difficult to make available a mechanical or manually visible means (other than mental) for displaying the meet scores. It is generally unfeasible to provide at these sites a scoreboard which may be effectively used by the players, yet will afford adequate protection against theft, vandalism, etc.

SUMMARY OF THE INVENTION

The inventor recognizing the need for providing a score-keeping device for such outdoor activities, created a compact and portable score-keeping device which could easily be slowed and transported, and subsequently erected at the outdoor activity site. The portable device includes: (a) a main frame member, (b) a score display panel supported by the member, (c) a retractable and extendible post section mounted to said member with said section being fitted with a terminal ground penetrating tip and a foot bracket for forcing the penetrating tip of the post section into the ground, and (d) latching means for retaining the post section in either a longitudinally extended position or in a retracted and stowable position.

DETAILED DESCRIPTION OF THE PREFERRED EMBODIMENTS

Figure 1:
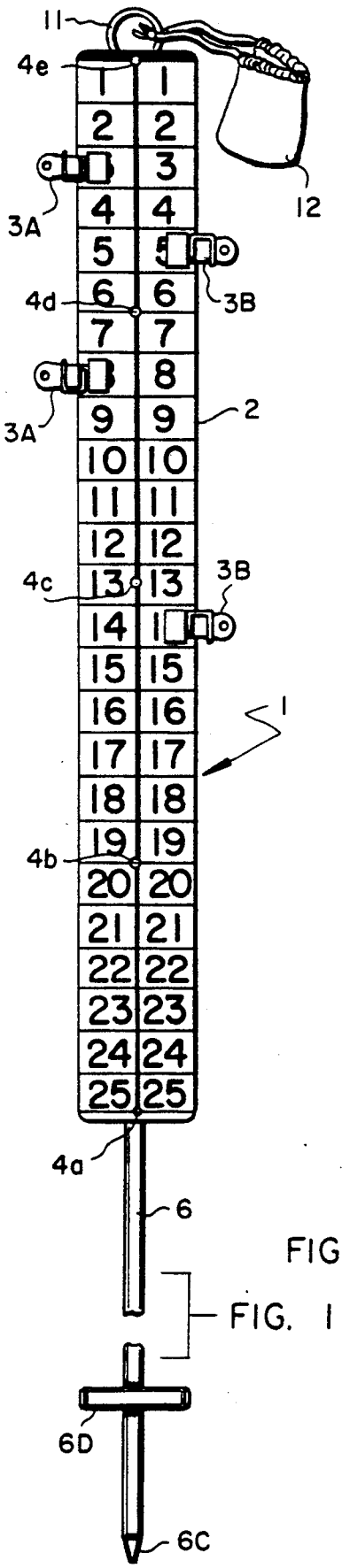
FIG. 1 is a front view of the scoring device in the longitudinally extended position.
Figure 3:
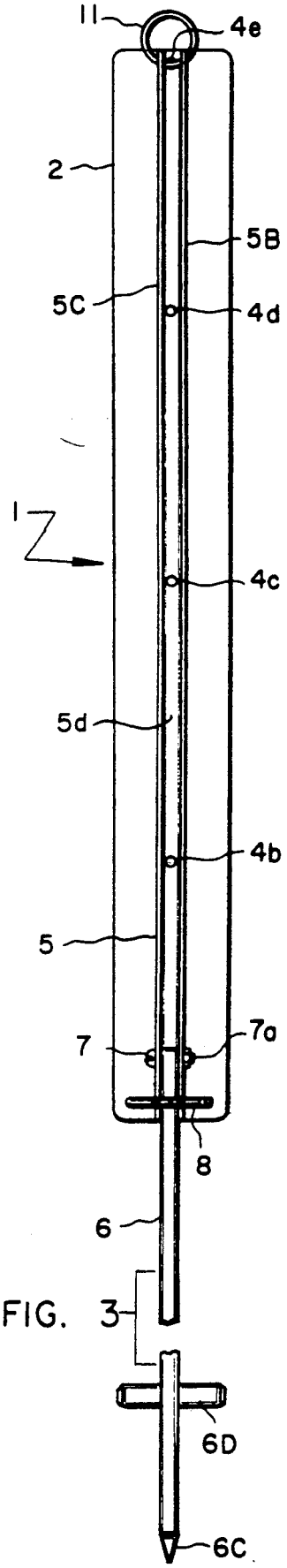
FIG. 3 depicts a rear view of the device shown in FIG. 1.
Figure 4:
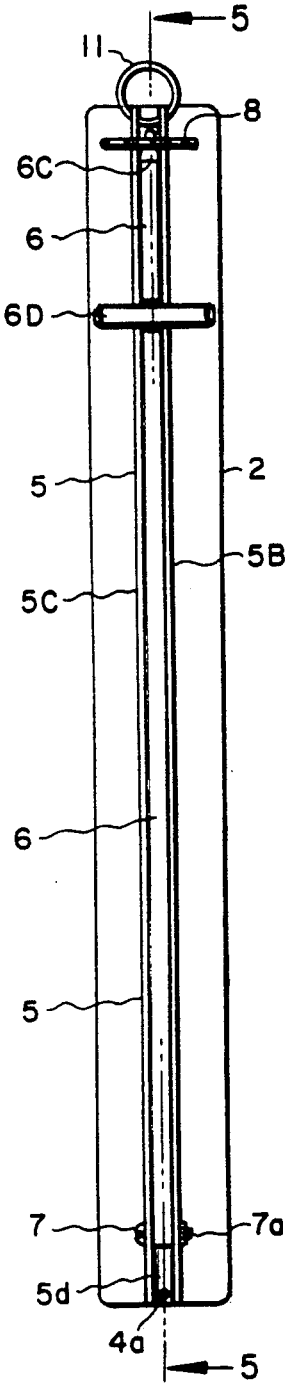
FIG. 4 is a rear view of the scoring device of FIG. 3 depicting the post section retracted therewithin to a compact and stowable position.
Figure 5:
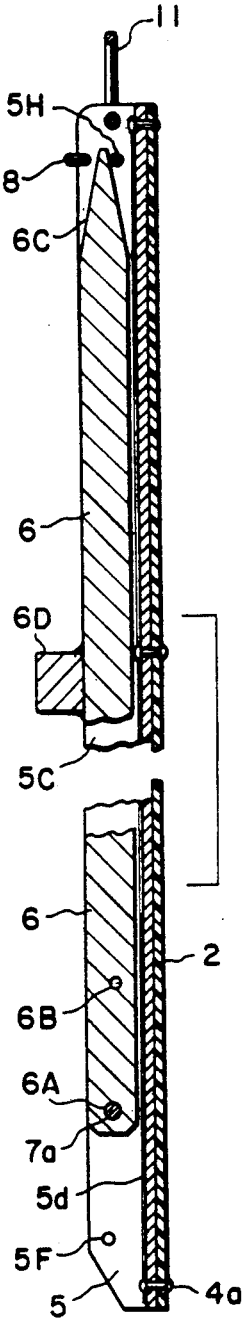
FIG. 5 is a cross-sectional side view of the device taken along lines 5—5 of FIG. 4.
Figure 6:
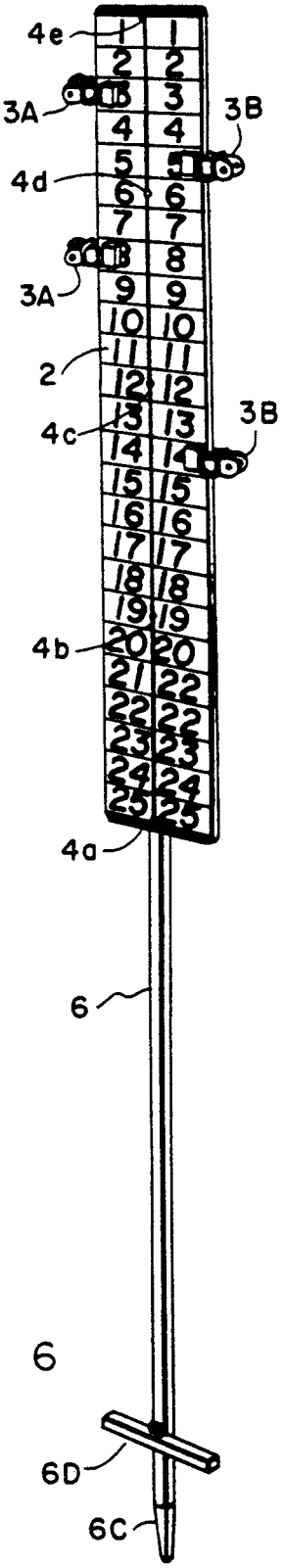
FIG. 6 is a full frontal view of the scoring device shown in the longitudinally extended posItion.

The present invention provides an outdoor scoring device (generally designated as 1) which may be extended to an upright position (as illustrated in FIG. 1, 3 and 6) and retracted (as shown in FIGS. 4–5) to a compact and stowable position.

In the preferred and more lifted embodiment of the invention, the scoring device 1 embodies a main frame member 5, a score display panel 2 supported by member 5, an adjustable post section 6 which may be adjusted to longitudinally extend from said member 5 and retracted into the member 5, and a latching means (explained in greater detail later) for retaining the post section 6 in a longitudinally extended posItIon in relationship to the major longitudinal axis of said member 5 and for retaining the post section 6 within said member 5.

As illustrated by FIGS. 1 and 6, the score display panel 2 includes partitioned regions containing enumerations for the recording at least two opposing scores thereupon and movable scoring indicators shown as four clothespin type clips 3A and 3B which may be manually manipulated within the partitioned regions to display the prior and current score thereupon. The depicted device 1 includes a score displaying panel 2 imprinted with numerical indicies of 1–25 Inclusive (in non-bold numerals) which in combination with movable score indicating clips (3A and 3B) respectively aligned along the left and right vertical margins of display panel 2 afford a manual means for recording and displaying the scores thereupon. Display panel section 2 is supported by or secured onto a main frame member 5 by rivets 4*a*, 4*b*, 4*c*, 4*d* and 4*e* (as specifically designated in FIGS. 1, 3 and 6) or any other appropriate attaching or securing means therefore.

By referring particularly to FIG. 3 rear view, the main frame member 5 is depicted as channeled piece (e.g. channel iron) wherein channel rims 5B and 5C and the recessed channeled portion 5D therebetween form a recessed channel portion facing in an opposite direction from which the score display panel section 2 faces. The depicted post section 6 is of a size and configuration so as to be mately housed within the channeled recess of member 5.

As shown in greater detail by the cross-sectional side view of FIG. 5, post section 6 is provided with a shaft receiving bore 6A which houses the shaft 7A of head bolt 7 (as shown in FIGS. 4 and 6) which in turn is retained a& a fixed position by a left shaft receiving aperture (occluded from view by head of bolt 7B) extending through left channel rim 5B, and a right shaft receiving aperture (occluded from view by nut 7*a*) extended through right channel rim 5C, and nut 7*b* for securing the head bolt 7 to member 5. The shaft 7*a* retained by bore 6A allows post section 6 to radially pivot about the longitudinal axis of member 5 within a 180 degree arc. The shaft 7*a* of bolt 7 and its pivotal mounting site to 5 are advantageously sufficiently recessed within the left rim 5B, right rim 5C and the internal recessed bridge portion 5D thereof so thai channeled region mating onto the neighboring post section 6 region thereto effectively functions as a bracketed stop to limit the pivotal movement of post sectIon 6 while also contributing to the longitudinal bracing and support of the extended post section 6 therewithin.

Left rim 5B and right rim 5C of member 5 are also depicted as being respectively provided with laterally registering apertures 5F and 5G (respectively designated in FIGS. 5 and 3) along the lower channeled margin of member 5 and the post section 6 also includes a retaining bore 6B (shown in FIG. 5) which correspondly aligns and registers onto apertures 5F and 5G when the post section 6 is pivoted to be fully extended position as depicted in FIGS. 1, 3 and 6. Removable clip 8 when inserted through apertures 5F and 5G of member 5 and the post section retaining bore 6B (as depicted in the retaining position in FIGS. 2 and 3) serves as a latching pin to retain the post section 6 in the fully extended position and in substantial longitudinal alignment with member 5. When it is desired to retract post section 6 into a compacted and stowable position, retaining clip 8 may be simply removed therefrom and the post section 6 nay then pivoted about the shaft 7*a* of bolt 7 until it nests within the channeled recesses of member 5 as illustrated in FIGS. 4 and 5.

Figure 2:
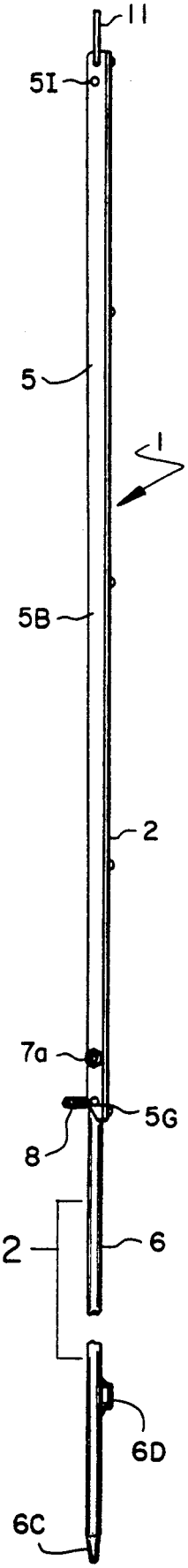
FIG. 2 is a side view of the FIG. 1 scoring device.

The device 1 is also provided with a means for retaining the post section 6 within the channeled member 5 in the retracted position as well as the extended position. The particular retaining means (as depicted in FIGS. 2 and 5) includes another set of laterally positioned and registering apertures 5H and 51 located along the upper margin of left rim 5B and right rim 5C of member 5 which when retaining clip 8 is inserted therewithin and retainingly engages onto the penetrating tip 6C of post section 6 serves to retain post section 6 within member 5 in the retracted position. Alternatively, member 5 may be modified (not shown) by repositioning apertures 5H and 51 at a channel rim site above shaft 7*a* so as to coincide and register onto bore 6B when the post section 6 is retracted within the channeled member 5 which in turn will allow clip 8 to be inserted through the repositioned 6H and 5I apertures and bore 6B for purposes of securing and retaining the retracted post section 6 therewithin. Other suitable means for retaining the post section in a retracted or extended position such as movable clamps bridging across the rim edges, set screws, etc. may also be used for this purpose.

The scoring device 1 is adapted to be driven into the soil and supported in an upright position thereby. By reference to the Figures, it will be observed that post section 6 is terminated by a soil penetrating tip 6C and a foot brace 60 which enables the user to effectively drive the penetrating tip 6C into the soil. The preferred foot brace 6D, as shown in the Figures, is depicted as being firmly secured onto and transversely extending outwardly from the lower portions of post section 6. The foot brace 6D is also advantageously positioned in sufficient proximity to the terminating portion of tip 6C to allow for it to be driven flushly with the ground. The brace 6D is accordingly depicted as being sufficiently removed from the distal end of the penetrating tip 6C to permit the post section 6 to be driven to a sufficient soil depth (e.g. about 4 to about 18 inches and preferably from about 5 to about 8 inches) and to provide sufficient supportive anchoring to maintain device 1 in the desired upright scoring position. The extending appendages of brace 60 when driven flushly into the ground forms a tri-planar support (i.e. the anchoring support planes formed by the grounded post section and each of the radially extending and ground supported planes of the two extending appendages of the brace) contributes an added stabilizing support in maintaining device 1 at the vertically extending posture. Brace 6D will advantageously horizontally and radially extend outwardly from at least two sides of post section 6 for purposes of further stabilizing device l against its dislodgement from the ground. Advantageously, the appendages will radially extend outwardly by at least one inch and preferably about two inches or more (e.g. about one and one-half to three inches). As is well recognized by horseshoers, the ground area in the horseshoeing court is typically heavily compacted which makes it difficult to drive posts into the ground. The penetrating tip 6C and brace 6D combination thus cooperatively enables the device 1 to be more easily driven into such compacted soil.

The movable scoring indicies 3A and 3B (e.g. as depicted in FIGS. 1 and 6) may be comprised of four springed clips or clamps onto the display panel section 2 (e.g. such as clothespin type clamps) which biasingly clamp and may be accordingly conveniently moved along the side margins of the scoring panel 2 to record the game score. Other manually manipulative scoring indicators such as magnets and magnetic boards as well as other manually movable scoring indicators may be used also for this purpose.

The preferred device 1 as depicted in the drawings also includes a support ring 11 attached to member 5 which serves for hanging device 1 onto a hang support. A drawstring cloth bag 12 (depicted In FIG. 1) for stowing the scoring indicies (3A and 3B) is also shown as being secured to ring 11.

The device 1 is advantageously constructed of materials possessing sufficient strength and rigidity to withstand the physical abuses of its intended use. the support member 5 and the post section 6 are advantageously of a heavy metal or durable and high-strength plastic (e.g. thermoplastic or thermoset) construction. If desired, the support member 5 and the panel display 2 may be of a unitary and integrated molded construction such as of molded plastic construction with the post section 6 being constructed of a material having sufficient strength and durability to allow for it to be effectively driven into the ground. The support member 5 and post section 6 are preferably of a metal channel construction such as aluminum, steel, iron, etc.

In the preferred embodiments of the invention, support member 5 includes a means for housing or stowing the post section 6 therewithin. Although the housing and stowing means of the support member 5 as depicted in the drawings comprises an open faced channeled recess, other means such as facing the channel inwardly towards display panel 2 with the post sectIon telescoping therefrom, a telescoping concentric pipe arrangement for support member 5 and post section 6 wherein the post section 6 nay be extended from or retracted within housing of member 5 and the like may also be used for this purpose. In such an arrangement, threaded couplers equipped compressive tightening rings or expanders, spring biased ball and socket combinations, spring biased latching mechanisms and the like nay be utilized as a means for retaining the post section 6 in extended or stowable positions. In the preferred embodiments of the invention, the post section 6 is preferably pivotally mounted or alternatively slideably engages onto housing 5. Member 5 also preferably serves to house substantially all of post section 6 in the fully retracted position. In the preferred embodiments, as illustrated in the Figures, the housing member 5 sufficiently overlaps onto post section 6 so as to substantially contribute to the longitudinal support and bracing of the post section 6 in its extended position.

In an alternative embodiment of the invention from that depicted in the drawings, channel rims 5B and 5C nay include mating retaining apertures and the post section 6 is likewise fitted with a bore which correspondly registers onto the mating retaining apertures of housing 5 when the section 6 is withdrawn to the fully retracted position. In this alternative embodiment, clip 8 may be simply inserted therewithin to retain the post sectIon 6 In the retracted position.

The scoring device 1 of this invention serves to provide a temporary scoring device which can be readily converted into a compact and stowable position for transport by the participants to the game site and may be readily erected to provide an on-site scoreboard. In an outdoor sport such as horseshoeing, the events are typically conducted at multiple contiguous courts in which the winning or losing participants move from one court to another court as the match progresses. Typically these participants must be verbally informed as to the status to the match play in these other courts so as to properly move to their next succeeding match. Occasionally, arguments will arise as to the correct score. Historically, horseshoeing had not been regarded as spectator sport which, by in large, is attributable to the fact that the spectators have difficulty in knowing the score tally of the multiple match plays. The present invention permits each match play score to be prominently displayed so that spectators as well as the participants may accordingly follow the game play of those matches of particular interest. The participants may accordingly better observe the game play of future opponents and formulate a game strategy. The foot brace 6D and penetrating tip 6C combination permit the user to expeditiously emplace the scoring standard at the appropriate soil depth with the winged brace structure resting upon and supported by the ground in conjunction with the said penetrating portion of the post section 6 affording a multiple planar stabilizing effect for anchoring and maintaining the scoring standard in the desired upright vertical position. The illustrated invention provides a collapsible, compact and stowable device which utilizes a single post driven into the ground to a predetermined distance in conjunction with its winged fool brace 6D structure to achieve a temporary, portable and ground anchored scoreboard.

The display panel 2 is preferably constructed of lightweight material of sufficient strength and durabIlIty to withstand the physical abuses of its intended use. The display panel 2 is preferably of a narrow width and elongated structure which longitudinally extends along at least a major portion (e.g. lengthwise portion) of the longitudinal of member 5, advantageously at least three-fourths (75%) and preferably covers the entire longitudinal length of support member 5. The display panel 2 is typically substantIally greater in length than its width (e.g. at least 2 to about 10 fold greater) and will generally fall within about 1 to about 4 foot range and most typically from about two to about four feet in length. The display panel 2 will typically be 10 inches or less in width (e.g. 1–10 inches), advantageously of about 2 to about 7 inches in width and preferably from about 3 to about 6 inches in width. The narrow display panel 2 width in relationship to its elongated length centralizes the erected device 1 center of gravity about its major longitudinal axis and further contributes towards stabilizing its anchoring within the ground and preventing its dislodgement by wind and other physical dislodging forces. The display panel 2 is also advantageously constructed of a rigid sheet material characterized as having a substantially lower specific gravity than those materials used in the construction of the post section 6 and support member 5. Such a construction further centralizes the center of gravity of the device about its major longitudinal axis to further contribute towards its erected stability. Low density metals, sheeting (e.g. aluminum), thermoplastic (e.g. polyvinyl chloride, polyolifines such as polyethylene, polypropylene, polystyrene, ABS, polyacrylics), thermoset composites (e.g. graphites, fiberglasses, etc.) and the like are particularly suitable fabricating materials therefore. In the most preferred embodiments of the invention, the display panel Z is constructed from a thermoplastic sheet material possessing excellent weathering attributes such as a polyvinylchloride.

For illustrative purposes, the scoring device 1 depIcted In the drawings nay be constructed from the following materials:

(A) a channel support member 5 fabricated from a 1/16 inch thick galvanized iron of an 0.8 channel measuring $\frac{5}{8}''$ in width and $\frac{3}{8}''$ depth, and an I.D. channel recess of about $\frac{1}{2}''$ in width and 5/16 inches in height, cut to about 36.5 inches in length, (B) a cold rolled steel bar stock measuring $\frac{1}{4}' \times \frac{1}{2}'' \times 34\frac{3}{4}''$ to fabricate post section 6, (C) a step bracket 6C fabricated from $\frac{1}{2}''$ diameter $\times 3\frac{3}{4}''$ steel concrete reinforcing rod, and (D) panel display 2 was fabricated from a 0.050 inch, weather resistant polyvinyl chloride outdoor siding piece cut to a $4\Delta \times 36.5''$ piece.

Four 3/6 inch mating holes were drilled through channel rims (5B and 5C) with a center drill point therefore being located about $\frac{1}{4}''$ removed from the recessed channeled portion facing of the channel member 5 at drill center points of about $\frac{1}{2}$ inch and $1\frac{1}{2}$ inch removed from one end of the cut channel stock to respectively serve as extended post section 6 retaining apertures 5F and 5G and the left and the right shaft receiving apertures for shaft 7. Two other registering drill holes were similarly cut into the channel rails at a position of about $5\frac{1}{4}''$ removed from the other channel stock end to serve as retracted pin apertures 5I and 5H. Two $\frac{1}{8}''$ holes (serving as shaft receiving bore 6A and post section retaining bore 6B) were drilled widthwise through the bar stock with the drill bit for the holes being centered at the bar stock side wall respectively at approximately 3/16" and 1" removed from one end of the bar stock so as to correspondly register onto the aforementioned $\frac{1}{2}''$ and $1\frac{1}{2}''$ holes of the channel member. The positioning of 3/16" drill hole was designed to permit the bar stock to pivot and clear the channeled recess when pivoted about shaft 7. If necessary, the end corner edges may be slightly rounded so as to permit the bar to pivot about 180 degree arc.

At the end opposite from the bar stock drill holes, the bar was sharpened to a pointed tip 6C and the iron concrete reinforcement rod 6D was perpendicularly centered and welded to the bar stock to at a 6" distance removed from the pointed tip apex. Four 3/16 inch holes equidistantly spaced apart (beginning at about 5/16" removed from the lower center margin) were made into the display panel 2 and four holes registering thereto were correspondly provided in the support member 5 for riveting display panel 2 onto channel member 5. The middle of display panel 2 face was then marked upon its face with paired enumerations of 1–25 and horizontally extending lines for separating each enumeration thereupon. The display panel 2 was then attached to the support member 5 by matching the correspondingly registering drill holes and riveting (4*a*, 4*b*, 4*c* and 4*d*) the panel 2 and member 5 together. A standard key ring 11 was inserted onto drill holes out into the channel stock. At the bottom end of the support member 5, the left and right shaft receiving apertures were aligned onto shaft receiving bore 6A and a $\frac{1}{8}'' \times \frac{3}{4}''$ threaded stove bolt 7 was inserted therewithin and bolted together with nut 7*b* to provide shaft 7*a* for the arcuate pivoting of post section 6 about the axis of shaft 7*a*. A hitch pin clip 8 (3/32" diameter) inserted through the lower channel member 5 and post section 6 drill holes served to retain the post section 2 in the fully extended position while the hitch pin clip 8 in conjunction with the laterally mating channel bores (i.e. 5H and 51) at the top side of member 5 for engagement onto the sharpened tip 6C serves to retain the post section 6 in the retracted position within the channeled housing of member 5. Four springed plastic clips (two painted black and two red) for clipping onto and along the vertical margin of the panel display 2 provided the means for tabulating the prior and current score thereupon. A draw-stringed bag 12 secured onto the ring 11 provided a convenient bag for stowing the scoring clips therewithin. If desired, the display panel may be further modified (not shown) to include indicies for manually tabulating the *match scores with manual scoring indicators such as mentioned above.

What is claimed is:

1. A compact and portable scoring device which when anchored onto ground in an upright position serves as a temporary scoreboard, said device comprising:

(a) a mounting frame;

(b) a retractable and extendable post section mounted to said frame with said post section including a terminating ground penetrating tip and a radially protruding appendage which serves as a brace for forcing the penetrating tip of the post section into the ground and as a stabilizing brace for maintaining the anchored device in the upright position;

(c) a score display panel supported by said frame; and (d) means cooperatively associated with said frame for retaining the post section in an extended ground penetrating position and means cooperatively associated with said frame for retaining the post section in a retracted position within said frame.

2. The device according to claim 1 wherein the post section is pivotally mounted onto said frame so as to permit the post section to be pivotally positioned to said extended ground penetrating position and pivotally retracted onto the frame in a compacted and stowable position therewithin.

3. The device according to claim 2 wherein a shaft mounted onto said frame serves as a pivotal mounting site for mounting said post section thereto and the frame includes a retraction stop and an extension stop which collectively serve to limit pivotal and arcuate movement of said post section about said shaft.

4. The device according to claim 2 wherein the post section comprises an elongated metal bar and the mounting frame comprises a channeled member for housing the post section therewithin in the pivotally retracted position.

5. The device according to claim 4 wherein the post section is pivotally mounted onto the channel member at a mounting site sufficiently removed within said channel member so that a portion of the channel member in association with a portion of the post section cooperatively serve to brace and support the post section in the extended ground penetrating position.

6. The device according to claim 5 wherein a latching pin engaging onto said frame and said section serves as the means for retaining the post section in the extended position.

7. The device according to claim 1 wherein the mounting frame comprises a channeled member, the post section comprises an elongated metal bar of a size and configuration so as to permit the section to be matingly housed within said member, and the device includes a shaft secured onto said member and the bar is pivotally mounted onto said shaft so as to permit the bar to be pivotally extended from said member to the ground penetrating position and pivotally retracted within said channel member for housing the bar therewithin.

8. The device according to claim 7 wherein the bar is pivotally mounted onto said channeled member at a mounting site sufficiently disposed within said member so that a portion of the channel member in cooperative association with the bar housed therewithin collectively serve to brace and support the bar in the extended ground penetrating position.

9. The device according to claim 8 wherein the bar includes a bar retaining aperture and the member which is fitted with post section retaining aperture which correspondly registers onto the bar retaining aperture when the bar is pivotally extended into the ground penetrating position and the device includes a latch pin which upon cooperative engagement with said bar retaining aperture and said post section aperture in cooperative association with the portion of the bar housed within the channel member collectively serve as the means for rigidly retaining the bar in the extended ground penetrating position.

10. The device according to claim 9 wherein the device includes a latch pin for retaining the post section in a retracted position.

11. The device according to claim 10 wherein the display panel, the member and the bar measure from about two feet to about four feet in length, the display panel measures from about two inches to about seven inches in width and the display is fabricated from a durable, weather-resistant plastic material of a substantIally lower specific gravity than said member and said bar.

12. The device according to claim 1 wherein the display panel is provided with scoring indicies for recording the scores of two opposing game play participants and the device includes manually movable score indicators engaging onto said display panel for recording the scores thereupon.

* * * * *